United States Patent [19]

Catena

[11] 4,061,301

[45] Dec. 6, 1977

[54] POLE INSERTER

[76] Inventor: Raymond Catena, Jr., 242 Highland Ave., Kearny, N.J. 07032

[21] Appl. No.: 766,889

[22] Filed: Feb. 9, 1977

[51] Int. Cl.[2] ..... A45F 3/44

[52] U.S. Cl. ..... 248/156; 248/531; 248/230

[58] Field of Search ..... 248/156, 85, 87, 96, 248/530, 531, 532, 533, 218.4, 230, 231; 211/29; 108/152; 173/30; 52/155

[56] References Cited

U.S. PATENT DOCUMENTS

| | | | |
|---|---|---|---|
| 1,312,918 | 8/1919 | McGuckin | 52/155 |
| 1,583,409 | 5/1926 | Marquart | 52/155 |
| 2,633,317 | 3/1953 | Marsh | 248/96 |
| 3,344,551 | 10/1967 | Chestnut | 248/156 |
| 3,679,162 | 7/1972 | Burley | 248/156 |
| 3,823,785 | 7/1974 | Toliver | 248/156 |

FOREIGN PATENT DOCUMENTS

| | | | |
|---|---|---|---|
| 262,586 | 7/1949 | Switzerland | 248/156 |
| 716,356 | 10/1954 | United Kingdom | 248/231 |

*Primary Examiner*—Marion Parsons, Jr.

[57] ABSTRACT

An apparatus for driving poles, rods and other objects into the earth, or into sand so that they may be self-sustaining in which the rod or pole is embraced by a strong strap, the ends of which extend outwardly from around the pole or rod, to receive between them a brace, the top of which is provided with a transverse flange defining a pedal; a bolt passed through the ends of the strap and the brace serves to rigidly secure the brace to a pole or rod; there are off set portions on the edges of the strap at each end thereof which define a support for a pedal.

3 Claims, 4 Drawing Figures

POLE INSERTER

BACKGROUND OF THE INVENTION

1. Field of Invention:

This invention relates generally to apparatus for inserting poles or rods into the earth or sandy beaches and particularly to a pedal adapted to cease a rod or pole so that weight may be applied to the pedal to enable the pole or rod to be driven into the earth.

2. Description of Prior Art:

The problem of inserting objects into the earth has existed for a long time and numerous devices for gripping rods and poles for such purpose or for other purposes have been devised. Crockett U.S. Pat. No. 148,875 (1874); Ritchie U.S. Pat. No. 108,832 (1870); Jordon U.S. Pat. No. 830,232 (1906); Reed U.S. Pat. No. 1,068,273 (1913); Frost U.S. Pat. No. 3,441,239 (1969); Jester U.S. Pat. No. 3,831,891 (1974). There still remains the problem of providing a readily attachable, rigid, strong, sturdy inserter that will sustain the application of large force to enable a pole or rod to be inserted in the earth. Many of the existing devices are not able to sustain the application of large amounts of force because they are not sturdy; others will slip. Still others are complex and expensive and difficult to apply.

SUMMARY OF INVENTION

It has been found that a pole or rod inserter can be provided as an accessory which can readily be applied to poles or rods, such as beach umbrellas and the like and may be secured thereto with great rigidity. Such a device must be resistant to deformation under conditions of use and will enable the application of high degree of force to be applied to the pole or rod so that it can be driven into the earth. In addition, the force may be applied by application of the foot to a pedal and after insertion is complete, the pedal may be utilized to sustain the weight of various objects and make them conveniently available. The device is sturdy and inexpensive and consists of a brace that is firmly anchored to a rod or pole by a strap; the brace bears on the rod or pole. The strip has off set bent over end portions to sustain a flange on the brace and to transfer the force directed toward the flange to drive the pole or rod into the ground.

THE DRAWINGS

These objects and advantages as well as other objects and advantages may be obtained by the device shown by way of illustration in the drawings in which FIG. 1 is a perspective view of the pole inserter with the component parts spacially disassembled;

PREFERRED EMBODIMENT

Figure 1:
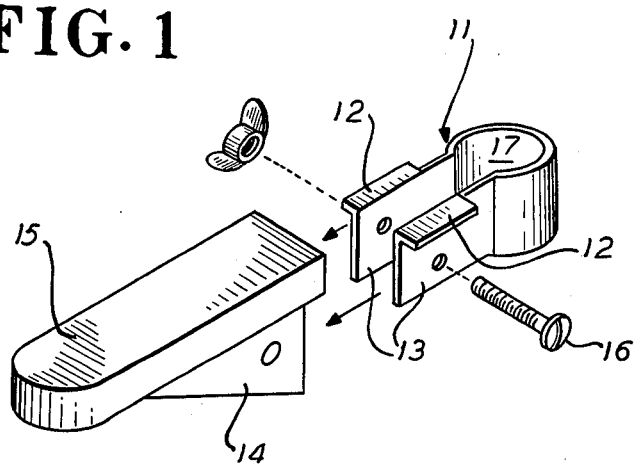
Figure 2:
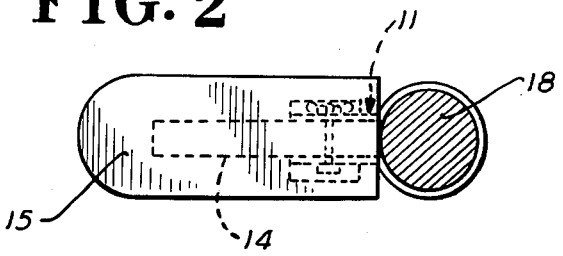
FIG. 2 is a top plan view thereof.
Figure 3:
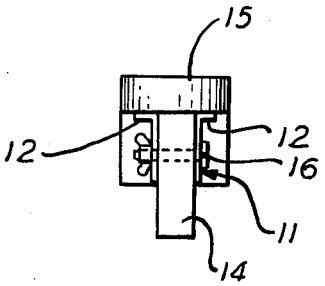
FIG. 3 is a front vertical elevational view thereof.
Figure 4:
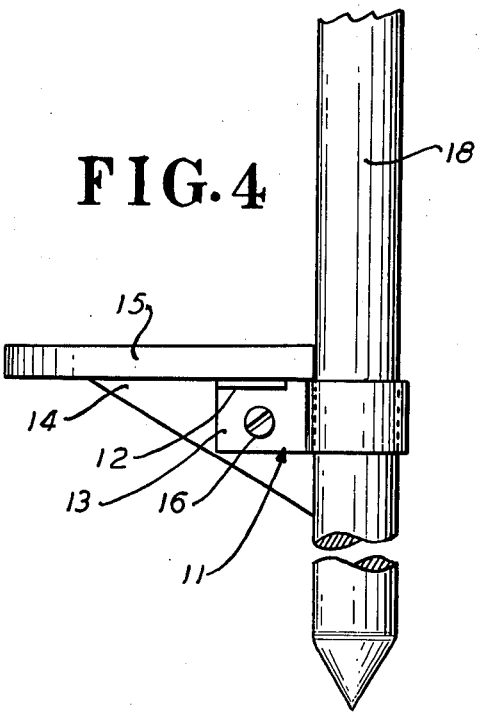
FIG. 4 is a side vertical elevational view thereof.

Referring now to the drawings in detail there is provided an elongated sturdy generally rectangular strap 11. The strap is preferably made of heavy metal such as a steel band. Each of the ends of the strap are provided with off-set edge portions 12, 12 disposed in general perpendicularity to that edge of the strap. These off set edge portions define a support for a pedal as will be later referred to. The ends 13, 13 of the strap are folded toward each other and disposed in spaced relation to each other with the off set portions extending away from each other outwardly on the strap 11 when folded. A brace 14 having a generally rectangular shape or tapered shape as shown in the drawings is interposed between the ends of the strap. The brace is provided with a top flange extending outwardly from the brace and defining a pedal to which the foot may be applied. The flange 15 on the top of the brace 14 is seated on the off set portions of the strap which serves to sustain the flange 15 while strong force is applied to it. Means in the nature of a holding device is then passed through the strap and through the brace. This may be a bolt 16 engaged with a nut. The straps can be tightened by the bolt 16. In the mid-portion of the strap 11 a space 17 is defined between the brace 14 and the strap 11. This space is dimensioned to receive a pole or rod in tight engagement when the bolt 16 is tightened with the nut. The brace has one vertical edge which is tightly engaged with a pole 18 or rod and the bolt is tightened to make this engagement extremely secure. When this is accomplished, the pole or rod may be grasped and moved back and forth as pressure is applied to the pedal defined by the flange 15. The rod is then driven into the surface to which it is applied, particularly if the rod is provided with a point. The pole inserter is particularly helpful when positioning umbrellas on the sand of a beach and serves the function of enabling the storage of articles on the pedal away from the sand of the beach. The pedal is also useful in enabling the umbrella, rod or other device to be released from the sand of the beach.

What is claimed is:

1. A pole inserter comprising:

a. an elongated generally rectangular strap, b. off-set edge portions at each end of the strap, disposed in general perpendicularity to the strap, and defining a support for a pedal, c. the ends of the strap folded toward each other and disposed in spaced relationship to each other, with the off-set portions extending away from each other on the strap when so folded, d. a brace positioned between the ends of the strap and having a generally flat vertical portion, e. a flange on the top of the brace defining a pedal, and seated on the off-set portions of the strap, f. a holding means passed through the brace and the strap to capture the brace and strap together when it is tightened, g. a space defined between the strap and the flat vertical portion of the brace dimensioned to receive a pole in tight engagement when the holding means is tightened, h. the end on the brace tightly engaged with the pole.

2. A pole inserter comprising:

a. the device in accordance with claim 1, b. a pole inserted into the space.

3. A pole inserter comprising:

a. the device according to claim 1, b. the pedal having a generally triangular configuration and tapering from the generally vertical flat portion, the outer end.

* * * * *